United States Patent [19]

Strickland

[11] Patent Number: 4,845,848

[45] Date of Patent: Jul. 11, 1989

[54] FLEXIBLE RAZOR

[76] Inventor: Edward Strickland, 2500 Kalakaua Ave., Honolulu, Hi. 96816

[21] Appl. No.: 172,258

[22] Filed: Mar. 23, 1988

[51] Int. Cl.[4] ..... B26B 21/06

[52] U.S. Cl. ..... 30/49; 30/32

[58] Field of Search ..... 30/32, 47–50

[56] References Cited

U.S. PATENT DOCUMENTS 4,516,320 5/1985 Pelerkis ..... 30/50

*Primary Examiner*—Douglas D. Watts

*Attorney, Agent, or Firm*—Solon B. Kemon

[57] ABSTRACT

This invention is concerned with the mounting of a flexible razor blade on a flexible holder such that the blade may be flexed about an arc having a radius as small as 1/8" or smaller to permit the blade to flow over protrusions or be flexed to shave through dimpled areas of the skin being shaved. The razor is useful for shaving over the jaw bone or shin bone areas for example without cutting the skin and may be pressed by the fingers of the user to delicately shave most any contoured area found on the normal skin of a human being.

15 Claims, 1 Drawing Sheet

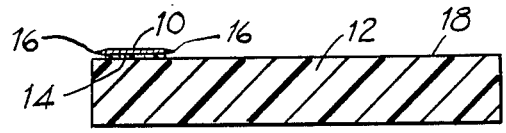
FIG. 2
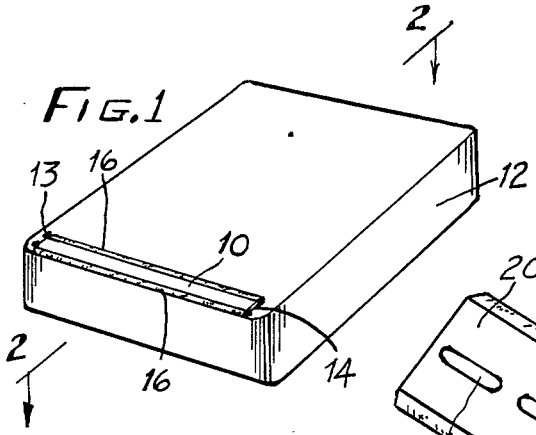
FIG. 1
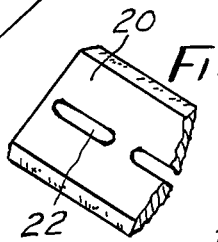
FIG. 3
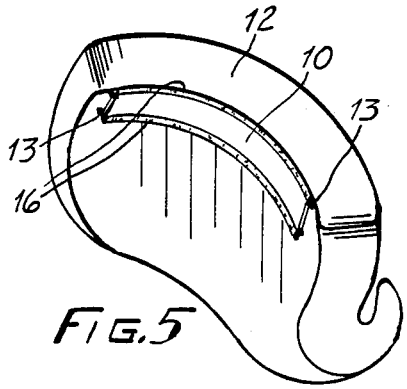
FIG. 5
FIG. 4
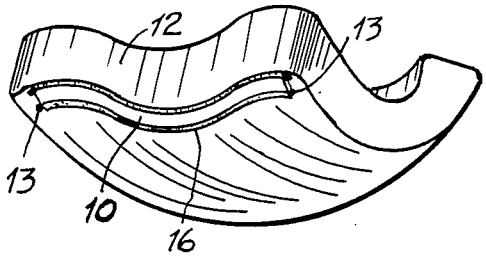
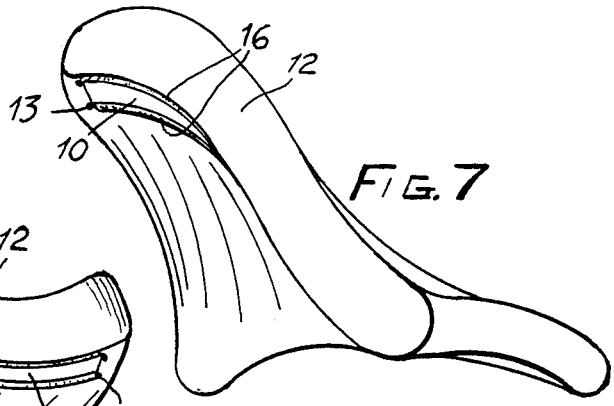
FIG. 7
FIG. 6
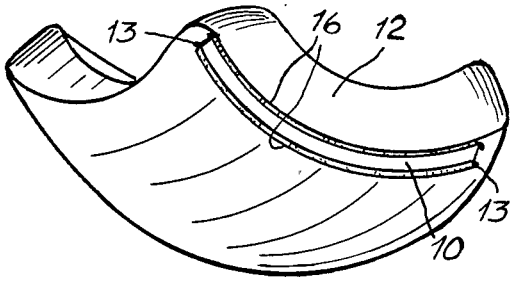

FLEXIBLE RAZOR

FIELD OF THE INVENTION

This invention relates to razors and more particularly to a flexible safety razor structure.

BACKGROUND OF THE INVENTION

The conventional safety razor makes use of a blade support structure that rigidly holds the blade that is pressed against the skin for shaving so that the skin is forced to be stretched into a substantially straight line for contact with the blade as the hair is being severed from the skin. These known structures must be pressed rather firmly against the face to engage the line of skin contact so that the razor's shaving edge can be pressed into depressed areas and conversely must be pressed lightly against the skin to avoid cutting it as the razor passes over protrusions that flow under the shaving edge when the razor is pulled over the surface being shaved. When deeper sharply defined dimples are present and when the shaving edge encounters surface conditions such as, for example, sharp jaw or shin bone areas which must be shaved, if the conventional razor is not precisely guided around such jaw bone or dimpled areas, etc., it is easily possible to cut through the outer layers of the skin and sometimes deep cuts are inflicted on the shaver.

Typical examples of known prior art razors that propose to show some form of flexibility in an attempt to ameliorate these difficult problems are shown in the following U.S. Patents:

| | | |
|---|---|---|
| U.S. Pat. No. 1383783 - to Billingsley | July | 1921 |
| U.S. Pat. No. 1932110 - to Koree | October | 1933 |
| U.S. Pat. No. 2521481 - to Rodriques | September | 1950 |
| U.S. Pat. No. 3262206 - to Tomek | July | 1966 |
| U.S. Pat. No. 3500539 - to Muros | March | 1970 |
| U.S. Pat. No. 3583262 - to Mullen | February | 1971 |
| U.S. Pat. No. 3587171 - to Perry | June | 1971 |
| U.S. Pat. No. 3777396 - to Simonetti | December | 1973 |
| U.S. Pat. No. 3823471 - to Stone | July | 1974 |
| U.S. Pat. No. 3832774 - to Perry | September | 1974 |
| U.S. Pat. No. 4069580 - to Cartwright et al | October | 1983 |
| U.S. Pat. No. 4409735 - to Cartwright et al | October | 1983 |

The Stone patent is typical of several that suggest an improved shave can be realized by providing a flexible handle means for supporting a more or less rigid conventional shaving head.

Muros illustrates a system for using a bendable guard bar in front of a substantially rigid blade means to alter the shaving edges exposure to the skin being shaved. This approach continuously alters the relative shaving angle of tangency of the blade to the face and the degree of edge exposure relative to the guard means as the razor is moved over the protruding and receding areas of the skin being shaved.

Billingsley provides a bendable support for a plurality of blades that are arranged in a parallel relationship and are caused to take a relatively more of less fanned out or different radiating angled position one with respect to the other, as the support for the shaving blades is flexed about its single axis of flexibility, which axis is parallel to the otherwise rigid blades themselves.

Koree is of interest only for the showing of a blade with an open center portion to permit the blade to flex in two planes when it is permanently clamped between the head 2 and guard 3 as the treaded shank of the head is engaged by the handle.

Muros discloses a flexible guard means disposed in front of a blade that is fixed in a shaving position. The location of the guard relative to the blade is resiliently determined by the pressure used in shaving but the blade is not flexed itself during the shaving process.

Mullen and Stone are concerned with flexible handle means used with otherwise flexible razor blades.

Perry U.S. Pat. No. 3,587,171 and Simonetti are of general interest in disclosing blades that may be adjusted to a fixed flexed position for shaving but the blades do not flex during the shaving process itself.

The Cartwright et al disclosures purpose to shown a somewhat flexible blade and support for mounting the blade. They describe a thin razor blade having a width of about 1 ½" and a length along a line perpendicular to the shaving edge that is substantially much less. The blade or a pair of blades are mounted in a flexible plastic holder that is adapted to be supported on a pair of parallel supporting bars carried on a conventional safety razor handle. The several Cartwright et al flexibly mounted blades are designed to bend in one direction only about "a 5 inch radius in response to normal human shaving forces", see col. 7 lines 30+in U.S. Pat. No. 4,409,725, which it is alleged, should make it conform to most of the contours encountered in the normal shaving process. The Cartwright et al blades are mounted to bend about only one axis that is perpendicular to the center point of the shaving edge of the blade.

BRIEF DESCRIPTION OF THIS INVENTION

The present concept of a truly flexible safety razor, as distinguished from the prior art, preferably makes use of a single, thin razor blade mounted on a flexible support that permits the blade either to be flexed by fingers or thumb or by the resiliency of the mounting body of the razor assembly itself when pressed against the skin not only about an axis parallel to a line perpendicular to its cutting edge but also permits the blade to be gently urged by such means into the around an infinite number of other non-parallel axes and even to be flexed spirally into either a convex or concave shape or if necessary it can be flexed to assume a compound curvilinear shape, The blade and its support have an ultimate flexibility permitting the flexible resilient shaving blade of this invention to be bent simultaneously at several positions along its length, about radii as small as ¼" or to the elastic limit of the blade material itself.

The flexible support carries the blade in a manner such that the support can be bent into the skin by any suitable means, but preferably by being grasped by the thumb and fingers of one hand with either the tips of the fingers or thumb spaced along the support in back of the blade to cause the blade to deflect, twist, and deform into intimate contact with all of the changing contours of the skin's surface that is being shaved, so that the shaving edge of the blade closely follows the smaller normal deviations in the surface of the skin. Somewhat lighter pressures need be applied to the flexible support and razor blade that is more intimately pressed into engagement with the skin by the fingertips or thumb of the user of the razor, which thumb or fingers are disposed along the length of the backside of the blade and may thus be made to shave dimpled areas along one portion of the width of the blade while another portion of the blade may be comfortably flexing to ride over a protrusion. As will be seen more full below, due to the utter flexibility built into the razor structure of this invention, it may be easily and safely pressed in any manner over the jaw or shin bone area of the skin without there being any fear of cutting the skin. This razor blade can be easily flexed to fit ever changing curves or spiral shaped for example, as the razor continuously flows over the changing contour of the face, the jaw bone, or shin bone, etc., irrespective of the angle of the approach of the blade to the skin as the razor moves over that area of the face or any other skin area that is being shaved. While it is preferable to apply gentle finger on thumb pressure to the back side of the razor support to urge the blade to conform to the many shapes of the skin, satisfactory flexion can also be obtained with other means. For instance, a rigid element could be fixed to the flexible razor assembly to apply shaving pressure provided it is of such a shape and or is located in such a position not appreciably to inhibit the blade mount assembly's flexibility. As an example, a grasping bar has been suggested, such as a bar of rigid plastic affixed to the flexible mount parallel to but separated from the blade.

IN THE DRAWINGS

FIG. 1 is a perspective view showing the preferred form of this invention in its relaxed state;

FIG. 2 is a sectional side elevation of the assembly taken on plane 2—2 as shown in FIG. 1;

FIG. 3 is an enlarged, broken away, perspective view of another form of a flexible razor blade;

FIG. 4 shows the assembly of FIG. 1 pressed by the fingers or thumb that are not shown, to deform the razor blade into a dimple;

FIG. 5 shows the assembly deformed to pass over a facial protrusion;

FIG. 6 shows the flexible blade and its support deformed into a larger single contoured area; and FIG. 7 shows how the flexible blade and its support can be made to flex into a spiral shape, as for example, when passing over a combination of jaw bone and cheek area of the face.

DETAILED DESCRIPTION

A preferred form showing the relaxed position of the invention is shown in FIG. 1 wherein the flexible razor blade 10 is adhesively secured to a flexible support member 12 with a line of a flexible adhesive 14 disposed between the blade and support member which cement permanently joins these elements together and permits the blade to flex with the support as will appear more fully below. The four corners of the blade are preferably covered with guard elements 13 that may take the form of drop of adhesive to prevent the corners from scratching the skin during the shaving process.

The razor blade may be made of a conventional razor blade metal and may be sharpened to provide cutting edge means 16 on one or both edges along the width of the blade as best seen in FIG. 2. Although the dimensions are not critical a blade having a width of about 1 ½ inches, a length measured perpendicularly to a cutting edge of about 0.10 part of an inch and a thickness of about 0.004 part of an inch or less has been found to be quite satisfactory. A thickness of 0.004 part of an inch is a normal safety razor blade dimension but a thinner blade is of curse more flexible and would afford an even more gentle shave. In the instances where a thinner blade is mounted on the backing it will be necessary to sharpen these thinner blade elements and mount them on each of their supports 12 to maintain a distance of about 0.002" part of an inch between the cutting edge 16 and the surface 18 to provide a passageway across the width of the forwardly moving blade during the shaving process for the free flow of soap and debris to exit around the opposite ends of the blade. Although there is some latitude in this spacing, greater distances can become dangerous while smaller distances can cause a depreciation in hair cutting quality.

The support member 12 is preferably cut from a sheet of foamed ethylene vinyl acetate having a density of about three pounds per cubic foot and is 3/16 part of an inch thick. A sheet of greater or less density with properly adjusted thickness will serve very well. Any similar flexible material may be used for the support; it may be made from most any flexible, foamed or nonfoamed resilient material providing there is a desirable stiffness to flexibility characteristic that is similar to that of the E.V.A. support. If a too thin or a too flexible support member is used, the blade may tend to chatter as it moved over the skin which too thin or too inflexible a material detracts from the operativeness of the razor so a very flexible, somewhat firm support member equivalent to the three pound per cubic foot ethylene vinyl acetate support should be used.

The razor constructed as above described is adapted to be brushed over the skin to be shaved by preferably grasping the support member 12 between the thumb that is placed on surface 18 and with the fingers on the other side of the support. Of course, if desired the position of the thumb and fingers can be reversed. Whether either the fingers or otherwise if the thumb is positioned on the support over the back side of the blade 10, the blade can be pressed against the skin. When the razor is pulled over the surface of the face with preferably the tips of the fingers pressing against the area of the support behind the back side of the blade, the blade and its support flex so that the shaving edge of the blade is conformed to the contour of the skin and engages the skin surface with an even pressure. The shaving edge 16 that is being moved into the area being shaved is thus made to uniformly engage the skin along an ever changing contour that forms the shaving edge's line of contact.

When the razor passes over a dimple for example, as shown in FIG. 4, pressure is best applied with the fingertip or thumb over the portion of the blade at the area of the dimple to cause the blade to be deformed and flex into that depression with an even pressure to shave all of the surface of the dimpled area. Similarly if a protrusion is encountered, as shown in FIG. 5 or FIG. 7, fingers can be applied evenly to press the blade to follow the undulating surface being gently shaved urging it continuously to flex as the razor moves over the protrusion and possibly a depression at the same time so that the shaving edge bears evenly against an ever changing shape of that surface.

This razor may be pulled over any area normally to be shaved and the flexible blade and its support can be lightly but firmly bent or pressed so that the entire length of a shaving edge 16 is in intimate contact along even an undulating line of skin to be shaved. When passing over the jaw bone area of a shaver, the blade and its support may be twisted into a spiral shape as shown in FIG. 7 or another form of a compound curve to flow over the surface being shaved with the full length of a shaving edge 16 in contact with the skin.

When any flexible razor having a normal 0.004" thickness is used for a normal shaving function, the above described blade mounted on a flexible support may be bent or pressed by the fingertips to arc around a curve having a radius in the range of $\frac{1}{4}$ to a $\frac{3}{8}$ part of an inch. A thinner blade or a blade with slots either parallel to as shown in FIG. 3, or at 90° to the cutting edge could be deformed into a curve having a smaller radius but I have found that with a thickness of 0.004" a curvalinear deflection around about $\frac{1}{4}$" to a $\frac{3}{8}$" radius of curvature provides a most acceptable shave and provides an even shave for all normally contoured surfaces to be shaved without requiring the use of a guard in front of the cutting edge 16 other than its normal spacing away from surface 18.

When twisted into a spiral form a 0.004" blade 0.10" long and about 1 $\frac{1}{2}$" wide can be turned so that its opposite ends are rotated at 90° one with respect to the other. An even more flexible blade is shown in FIG. 3 wherein a blade 20 may be provided with a series of longitudinal or horizontal slots that are parallel to or at 90° with respect to the cutting edge.

While a conventional procedure makes use of a series of successive pulling strokes to complete a shave, when a razor with two shaving edges as shown in FIG. 2 is used, a desired shaving action can be performed in one half the time as the razor is both pushed and pulled over the surface to be shaved. When used in this manner a series of quick reciprocating shaving strokes are used to speed up the shaving process. This procedure can be followed because the blade 10 is pressed flat against the skin being shaved and is bent by the fingertips or thumb disposed along the support behind the back side of the blade 10 to press first one and then the other one of the two shaving edges 16 against the line of the skin being shaved as above described and both of these edges are equally effective to perform the shaving action.

It should be noted, that with the elimination of any form of guard especially the one positioned in front of the cutting edge, the edge engages a line of fully lubricated hairs. The shaving soap or cream remains applied to the hairs at the shaving instance. This action is to be contrasted with the action of a conventional razor that has a guard in front of its razor's edge, and since this guard bears against the skin being shaved the guard cleanly scrapes the shaving soap away from the hairs to be shaved as the shaving edge approaches the hairs to leave the hairs virtually devoid of all the lubrication which would otherwise substantially assist the blade in its shaving activity. Since there is no guard in front of either one of the shaving edges of this invention, it is possible to accomplish a more comfortable and better lubricated shave with the flexible razor described above.

The above description covers the preferred form of my invention. It is possible that modifications thereof may occur to those skilled in the art that will fall within the scope of the following claims.

I claim:

1. An improved razor for shaving hair form all areas of the skin including areas having an undulated surface; comprising a shaving blade having cutting edge means for engaging the skin along a shaving line, said blade being flexible; a flexible mounting means having two opposed sides for supporting said blade, said blade being fixed to a zone on one side thereof, said mounting means including a portion extending beyond said (mounted blade) zone, which portion may be engaged by a thumb and fingers of the user for manipulating and moving said blade in contact with the skin by pressure applied to the other of said sides of the mounting means over said zone (said cutting edge means of said blade,) to move said blade and said edge actively over an area of the skin that is being shaved; said blade mounted on said mounting means being adapted to be pressed successively by one or the other of said thumb and fingers into one of either a simple or compound curved shape when the user causes the blade to be pressed against the skin and then moves the mounted blade over the surface of the skin being shaved; whereby to cause said actively moving cutting edge means to continuously engage the skin and be contoured to press against the skin substantially uniformly along a moving line in said area of the skin being shaved, which line may be forced to travel over an undulated area of the skin.

2. An improved razor as in claim 1 wherein said shaving blade has a resilient property that permits it to be deformed to engage the skin along a shaving line that is a simple curve with a radius as small as $\frac{3}{8}$".

3. An improved razor as in claim 1 wherein said shaving blade has a resilient property that permits it to be deformed to engage the skin along a shaving line that is a compound curve.

4. An improved razor as in claim 1 wherein said shaving blade has a resilient property that permits it to be deformed to engage the skin along a shaving line that is a spiral.

5. An improved razor as in claim 1 wherein said shaving blade has a thickness of about 0.004", a width of about 1 $\frac{1}{2}$" and a length along a line perpendicular to said cutting edge means of about 1/10".

6. An improved razor as in claim 5 wherein said blade has a resilient property that permits it to be deformed to engage the skin along a shaving line that is a compound curve in the form of a spiral wherein the opposite ends of the blade can be disposed at a right angle one with respect to the other.

7. An improved razor as in claim 5 wherein said blade has a resilient property that permits it to be deformed to engage the skin along a shaving line that is a compound curve having generally planar and curved portions.

8. An improved razor as in claim 1 wherein said blade has an elongated rectangular shape and has cutting edge means on each of its two longer edges.

9. An improved razor as in claim 2 wherein said blade has an elongated rectangular shape and has cutting edge means on each of its two longer sides.

10. An improved razor as in claim 2 wherein said blade has an elongated rectangular shape and has cutting edge means on each of its two longer sides.

11. An improved razor as in claim 4 wherein said razor has an elongated rectangular shape and has cutting edge means on each of its longer sides.

12. An improved razor as in claim 5 wherein said blade has cutting edge means along each of its 1 $\frac{1}{2}$" sides.

13. An improved razor as in claim 12 wherein said blade has a resilient property that permits it to be deformed to engage the skin along a shaving line that is a compound curve in the form of a spiral wherein the opposite ends of the blade can be disposed at a right angle one with respect to the other.

14. An improved razor as in claim 12 wherein said blade has a resilient property that permits it to be deformed to engage the skin along a shaving line that is a compound curve having generally planar and curved portions.

15. An improved safety razor device having at least one ultra flexible razor blade means, said blade means including at least one blade having front and back sides and at least one cutting edge which safety razor device utilizes the pressure of a user's thumb or tips of the forefingers to flex said blade means to cause a cutting edge to bend or twist to substantially match the undulations normally encountered on the surface of the skin's topography; either one of said thumb or the tips of the forefingers being positioned to produce a pressure against the backside of one of said at least one razor blade means during the shaving process to urge its cutting edge to curve into concavities, around convexities, to assume a spiral shape or to cause said pressurized blade to lie flat or to otherwise engage the skin continuously to enable said cutting edge to cut a swath of hair that has a length that is substantially as wide as the width of said cutting edge; a flexible mounting means having two opposite sides for supporting said blade means with the back side of said at least one blade mounted on one of said opposite sides of said mounting means; said mounting means including a portion that extends beyond said at least one razor blade means which mounting means is adapted to be engaged by the fingers and thumb of the user to assimilate the thumb or finger pressure applied thereto to urge said one of said at least one blade means and a cutting edge against the skin by applying said pressure with either the thumb or forefinger's tips against the other of said opposite sides of said mounting means and against the backside of said one of said at least one razor blade means.

* * * * *

UNITED STATES PATENT AND TRADEMARK OFFICE

CERTIFICATE OF CORRECTION

PATENT NO. : 4,845,848

DATED : July 11, 1989

INVENTOR(S) : Edward Strickland

It is certified that error appears in the above-identified patent and that said Letters Patent is hereby corrected as shown below:

In Claim 1, column 5, line 60, delete "form" and insert -- from --.

Column 5, lines 67 and 68, delete "(mounted blade)".

Column 6, line 4, delete "(said cutting edge means of said blade,)".

Signed and Sealed this

Nineteenth Day of June, 1990

*Attest:*

HARRY F. MANBECK, JR.

*Attesting Officer*

*Commissioner of Patents and Trademarks*